US007390134B2

(12) United States Patent
Bateman et al.

(10) Patent No.: US 7,390,134 B2
(45) Date of Patent: Jun. 24, 2008

(54) RIBBON IDENTIFICATION

(75) Inventors: Daniel R. Bateman, Ladera Ranch, CA (US); Connie R. Bowen, Santa Ana, CA (US); Kevin P. Moore, Irvine, CA (US); Charles Baldwin Ranson, San Clemente, CA (US); Dennis R. White, Yorba Linda, CA (US)

(73) Assignee: Printronix, Inc., Irvine, CA (US)

( * ) Notice: Subject to any disclaimer, the term of this patent is extended or adjusted under 35 U.S.C. 154(b) by 42 days.

(21) Appl. No.: 11/110,138

(22) Filed: Apr. 20, 2005

(65) Prior Publication Data

US 2006/0239742 A1 Oct. 26, 2006

(51) Int. Cl.
*B41J 33/12* (2006.01)
*B41J 33/32* (2006.01)
*B41J 35/28* (2006.01)

(52) U.S. Cl. ..... 400/249; 400/207; 400/242

(58) Field of Classification Search ..... 400/203, 400/207, 208, 208.1, 219, 219.3, 219.4, 231, 400/232, 239, 244, 249, 279–281, 719, 242
See application file for complete search history.

(56) References Cited

U.S. PATENT DOCUMENTS

| | | | | |
|---|---|---|---|---|
| 4,401,394 | A | 8/1983 | Hume | |
| 5,087,137 | A * | 2/1992 | Burnard et al. | 400/249 |
| 5,108,209 | A | 4/1992 | Menzenski | |
| 5,393,149 | A * | 2/1995 | Iima | 400/208 |
| 5,755,519 | A | 5/1998 | Klinefelter | |
| 5,807,005 | A | 9/1998 | Wright | |
| 6,021,283 | A * | 2/2000 | Yoshida | 396/408 |
| 6,059,469 | A | 5/2000 | Hirumi | |
| 6,076,982 | A | 6/2000 | Katsuno | |
| 6,089,768 | A | 7/2000 | Barrus | |
| 6,099,178 | A | 8/2000 | Spurr | |
| 6,152,625 | A | 11/2000 | Oliverio | |
| 6,493,017 | B1 | 12/2002 | Huang | |
| 6,503,007 | B1 | 1/2003 | Furrow | |
| 6,539,867 | B2 | 4/2003 | Lee | |
| 6,676,312 | B2 | 1/2004 | Richard | |
| 6,767,147 | B2 | 7/2004 | Jakubowski | |
| 6,786,660 | B1 | 9/2004 | Woosley | |
| 6,962,451 | B2 * | 11/2005 | Narita et al. | 400/207 |

FOREIGN PATENT DOCUMENTS

| | | | |
|---|---|---|---|
| JP | 01233431 A | * | 9/1989 |
| JP | 11321002 A | * | 11/1999 |

* cited by examiner

*Primary Examiner*—Daniel J. Colilla
*Assistant Examiner*—'Wynn' Q Ha
(74) *Attorney, Agent, or Firm*—Tom Chen; MacPherson Kwok Chen & Heid, LLP

(57) ABSTRACT

A ribbon identification system detects a digitally encoded tract comprised of radially printed bands of dark and light areas positioned on a ribbon spool that fits on a media printing device. Each type and length of ribbon to be used is associated with a specific and unique digitally encoded tract. When the ribbon spool is positioned correctly on the printing device, the digitally encoded tract is detected, and the control program of the printing device sets the parameters associated with that ribbon automatically ensuring proper printing. Through the digitally encoded tract, the ribbon spool is uniquely identified so that once it has been determined by the printing device's control program that the ribbon has been depleted, that ribbon spool, if reinstalled on the same printing device at a later time, will be recognized as a depleted ribbon, and the printing device will not function.

10 Claims, 2 Drawing Sheets

RIBBON IDENTIFICATION

BACKGROUND

1. Field of Invention

The present invention relates to printer ribbons and systems, and in particular, to such systems that enable identification of ribbon characteristics.

2. Related Art

Printer systems utilize ink ribbons to print visually readable characters onto media, such as paper. The ink ribbon is typically wound onto a spool and may be contained in a cartridge for storage, transportation, and handling. The spool, with or without the cartridge, is mounted in the printer system. The spool then rotates as the ribbon is fed through the printer during a printing operation to transfer the ink onto the media.

Various kinds of ink ribbons with many different characteristics are available for use in printer systems. Ribbon characteristics include the fabric type, ribbon length, ink color, and ribbon width. Each type of ribbon may have several parameters that a printer system needs to be aware of in order to accommodate that particular ribbon type. For example, printing density, ribbon feed synchronization, and/or number of printing jobs available may all need to be adjusted. Identification of the various characteristics can be important for printer operation and optimization of print quality. For example, if a certain type of print ribbon spool or cartridge is inserted into a non-compatible printer, the printer may not operate at all. If a printer is set to print black characters, a color ribbon may result in poor print quality on the media. Another situation may be that the printer is unable to detect when the ribbon is depleted, resulting in possible damage to the printer or inferior or non-existent printing.

Numerous ribbon identification devices and methods have been proposed. Some determine the identification of the ribbon. Others determine whether the ribbon or cartridge is exchanged. Still others determine whether the ink or ribbon is depleted. The characteristic for identification can be placed on the ribbon or on the cartridge. For example, a material different than the ribbon can be attached near the end of the ribbon so that a detection mechanism can determine when a ribbon supply is ending. Other types of detection mechanisms can be configured to detect the amount of ink remaining on the ribbon, either by directly sensing the amount of ink on the ribbon or by measuring the amount of ink transferred onto the print media.

Identifiers can also be placed on the ribbon cartridge or ribbon core, such as a bank of color coded bands, a resistive ink identifier, or a semiconductor chip or memory storing readable ribbon characteristics. As these identifiers pass by a sensing mechanism, such as photo-optical, magnetic Hall Effect, and other proximity-type detectors, the information contained therein is read and processed. Thus, such ribbon identification schemes are usually limited in the type and amount of information that can be read by the printer system.

Further, such ribbon identification systems typically require the detection mechanism on the printer to determine the format of the identifier as well as how the identifier is to be scanned and read. This can add complexity to both the reader and the ribbon identifier.

Therefore, there is a need for a ribbon identification system that overcomes the deficiencies of conventional systems discussed above.

SUMMARY

According to one aspect of the present invention, a ribbon identification system utilizes a radial barcode label along at least an arc portion of a ribbon spool or container. In one embodiment, the radial barcode is along an outer portion of the spool. The radial barcode comprises a sequence of light and dark bars of varying separation and widths, which are unique to a specific printer system or ribbon. The radial barcode is coded to convey information, such as the ribbon type and length.

The spool containing the ribbon is loaded into a printer system. The spool is positioned such that an optical detector, such as a photo-sensor, is able to read the barcode on the spool as the spool rotates. In one embodiment, the detector illuminates the radial barcode as the spool rotates to read the sequence of light and dark bars. Typically, the radial barcode does not span the entire circumference of the spool, although a circular or near-circular radial barcode can be used if desired, such as with smaller spools or when large amounts of information are stored on the barcode. Thus, a single rotation enables all the information from the barcode to be read.

Once the information is read, the printer automatically receives and sets the parameters to operate the printer using the ribbon characteristics, such as type and length of ribbon detected. As a result, the printer can then optimize its print settings for the particular ribbon to increase print performance. For example, for a specific length of ribbon, the printer system can calculate at what point the ribbon is depleted. When that occurs, the printer will automatically stop printing and may notify the user that a new ribbon is needed.

The radial barcode of the present invention provides numerous advantages over conventional ribbon identification and barcode systems. For example, since the barcode is unique to the printer, ribbon identification is more efficient. One reason being that the barcode uniquely identifies the ribbon for a specific printer system, which enables the printer system to quickly determine if the detected barcode is the correct barcode (and therefore, the correct ribbon), for the printer. In other words, the barcode no longer needs to contain additional information to identify it to the printer, resulting in a more succinct code with a reduced footprint on the spool. Furthermore, the printer system does not need to know this additional information in order for the printer system to properly read or scan the information on the barcode. This is in contrast to conventional methods in which barcodes have additional bits to tell the printer the format of the barcode and how it is to be scanned, such as a start character, a check character, and a stop character. Thus, using the radial barcode of the present invention, the printer system can determine immediately whether the ribbon is compatible, e.g., by simply determining if the barcode is a correct one for the particular printer system, as opposed to more generally formatted barcodes which would require the printer system to scan and process more initial information. If the barcode is correct, scanning can proceed without having to determine the read conditions since the ribbon is specifically coded and for use with the printer system. Further, since each ribbon identifier is unique to the ribbon, the printer system can store in memory the ribbon identifier of all ribbons installed or used by the printer.

The radial barcode of the present invention also enables the printer system to quickly determine whether to proceed with configuration and printing or to disable operation. The printer does not print if the printer system does not detect a code, determines the ribbon is depleted, determines that the ribbon is incompatible, or the code is unreadable. By not operating in these situations, damage to the printer and/or poor quality printing is prevented.

This invention will be more fully understood in light of the following detailed description taken together with the accompanying drawings.

BRIEF DESCRIPTION OF THE DRAWINGS

It should be appreciated that like reference numerals are used to identify like elements illustrated in one or more of the figures.

DETAILED DESCRIPTION

Figure 1:
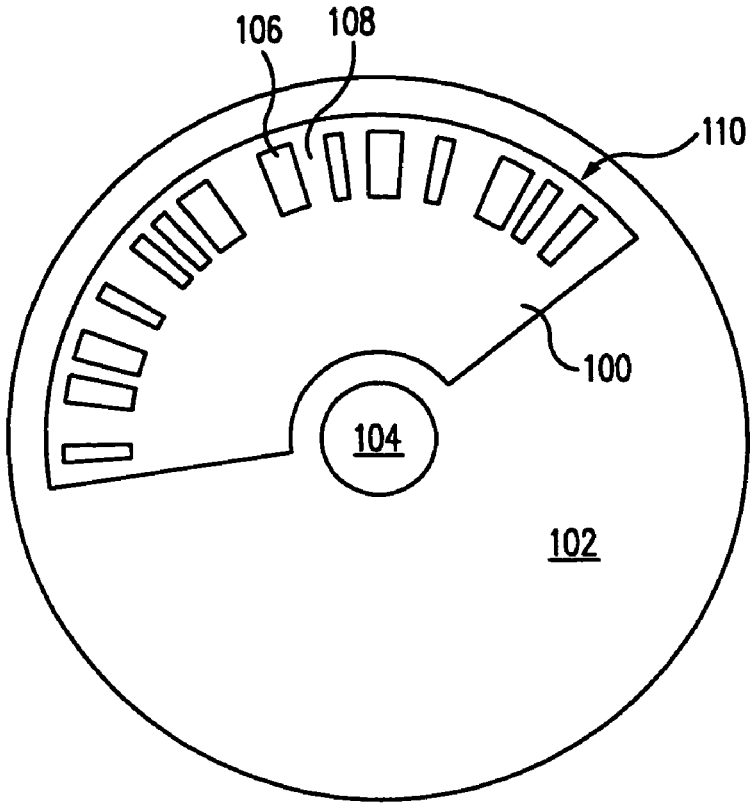
FIG. 1 is top view of a ribbon spool having a radial barcode according to one embodiment of the present invention.

FIG. 1 is a top view of a radial barcode 100 according to one embodiment of the present invention. Radial barcode 100 is on a side, either top or bottom, of a spool 102. Spool 102 is a standard circular spool, in which print ribbon (not shown) is held. The print ribbon is wound onto spool 102 and unwound for printing by a take-up spool. An opening 104 in spool 102 enables spool 102 to be inserted into a rotatable spindle on the printer system.

Radial barcode 100 includes a series of "dark" or non-reflective bars 106 and "light" or reflective bars 108 of varying width and separation. As is known in the art, barcodes can be used to store information, based on the width and separation of the bars, which represent digits from 0 to 9. Conventional barcodes can be used, including various forms and symbologies of linear barcodes. One difference is that typically linear barcodes are a horizontal series of bars, while in the present invention, the series of bars 106 and 108 are formed along an arc. Another distinction from conventional barcodes is the format. A typical barcode includes a first or leading quiet zone, a start character, data characters including an optional check character, a stop character, and a second or trailing quiet zone. However, in one embodiment of the present invention, radial barcode 100 does not have a start character, a stop character, or a check character, as will be discussed in more detail below. In one embodiment, the radial barcode is coded to identify the length of the ribbon, the type of ribbon, and a unique identifier for the ribbon. Each of these three identifiers can be in a separate field of the barcode. Table 1 below list some examples of ribbon types and properties.

TABLE 1

| Manufacturer | Name | Length | Thickness | Yield | Region | Mult. | Dots/Yd/ Band | Code |
|---|---|---|---|---|---|---|---|---|
| Printronix | P7000 Ultra Capacity | 130 | 4 mil | 22M | 0 | 0 | 118374 | 19 |
| Printronix | P7000 Ultra Capacity-AP | 130 | 4 mil | 22M | 1 | 0 | 118374 | 19 |
| Printronix | P7000 High Contrast | 130 | 4 mil | 20M | 0 | 0 | 101486 | 17 |
| Printronix | P7000 High Contrast-AP | 130 | 4 mil | 20M | 1 | 0 | 101486 | 17 |
| Printronix | P7000 Ultra Capacity | 60 | 4 mil | 10.2M | 0 | 0 | 118374 | 19 |
| Printronix | P7000 Ultra Capacity-AP | 60 | 4 mil | 10.2M | 1 | 0 | 118374 | 19 |
| Printronix | P7000 High Contrast | 60 | 4 mil | 9.2M | 0 | 0 | 101486 | 17 |
| Printronix | P7000 High Contrast-AP | 60 | 4 mil | 9.2M | 1 | 0 | 101486 | 17 |
| Printronix | P7000 Ultra Capacity All Purpose | 100 | 5 mil | 25M | 0 | 0 | 173930 | 24 |
| Printronix | P7000 Ultra Capacity All Purpose-AP | 100 | 5 mil | 25M | 1 | 0 | 173930 | 24 |
| Printronix | P7000 Ultra Capacity All Purpose | 55 | 5 mil | 14M | 0 | 0 | 173930 | 24 |
| Printronix | P7000 Ultra Capacity All Purpose-AP | 55 | 5 mil | 14M | 1 | 0 | 173930 | 24 |
| Printronix | P7000 Red Ribbon | 130 | 4 mil | 18M | 0 | 0 | 93969 | 16 |
| Printronix | P7000 Blue Ribbon | 130 | 4 mil | 18M | 1 | 1 | 93969 | 16 |
| Printronix | P7000 Green Ribbon | 130 | 4 mil | 18M | 2 | 2 | 93969 | 16 |
| Printronix | P7000 UV Ribbon | 130 | 4 mil | 16.2M | 0 | 0 | 87008 | 15 |
| Printronix | P7000 Laundry Ribbon | 130 | 4 mil | 16.2 | 1 | 1 | 87008 | 15 |
| Printronix | P7000 Quick Dry Ribbon | 130 | 4 mil | 15M | 0 | 0 | 80563 | 14 |

TABLE 1-continued

| Manufacturer | Name | Length | Thickness | Yield | Region | Mult. | Dots/Yd/ Band | Code |
|---|---|---|---|---|---|---|---|---|
| Printronix | P7000 Tamper Evident | 130 | 4 mil | 15.6M | 1 | 1 | 80563 | 14 |
| Printronix | P7000 Security Ribbon | 130 | 4 mil | 30M | 0 | 0 | 161046 | 23 |
| IBM | 6500 Ultra Capacity | 100 | 5 mil | 22M | 0 | 0 | 149117 | 22 |
| IBM | 6500 Ultra Capacity | 55 | 5 mil | 10.2M | 0 | 0 | 127843 | 20 |
| Authorized Manufacturer | Printer Ribbon | any | 4 mil | any | any | Any | | |

Radial barcode 100 can be printed on an adhesive label 110, such as dot matrix, ink jet, laser, or thermal printing. In other embodiments, radial barcode 100 may be printed directly onto spool 102. FIG. 1 shows radial barcode 100 located along an outer arc of the spool and only occupying a sector of the spool. However in other embodiments, the radial barcode may be located on an interior arc of the spool and/or occupy an entire circumference of the spool.

Figure 2:
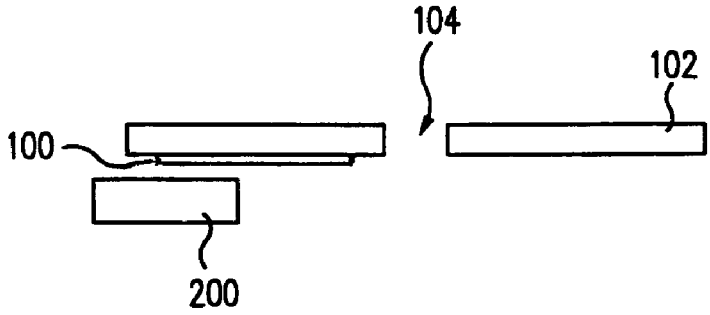
FIG. 2 is a side view of the ribbon spool of FIG. 1 mounted in a printer system with an optical reader according to one embodiment.

FIG. 2 shows a side view of spool 102 in position to be read by a detector, such as an optical reader 200. Optical reader 200 can be any suitable barcode reader, such as an optical reader, scanner, or laser. For example, optical reader 200 uses a laser beam or LED to illuminate the radial barcode. The reflections are then detected and translated into digital data that is transferred to a processor, which processes the data and uses it to control various functions of the printer system, such as configuration. Optical reader 200 is placed in close proximity to radial barcode 100 to enable reader 200 to accurately read the barcode. Optical reader 200, in one embodiment, is located at the outer circumference of spool 102, corresponding to the placement of radial barcode 100. FIG. 2 shows optical reader 200 underneath spool 102 and directly under radial barcode 100 in one embodiment. However, in other embodiments, optical reader 200 may be placed directly above radial barcode 100.

Optical reader 200 reads the radial barcode as spool 102 rotates across the face of optical reader 200. Bars 106 and 108 forming radial barcode 100 are coded and printed to uniquely identify the ribbon for a specific printer system. Thus, contrary to conventional ribbon identification schemes or barcodes, more information about the ribbon can be stored in the radial barcode and/or a smaller sized barcode is possible since certain specific characters are no longer needed. In one example, only forty bits or less may be needed to properly encode the ribbon using the radial barcode of the present invention. Further, the printer system, such as the take-up spool, controls the rotation or movement of spool 102 so that the printer system or processor "knows" which direction to scan the radial barcode. Because the radial barcode is unique to the printer system, numerous advantages are possible for the configuration and operation of the printer.

Figure 3:
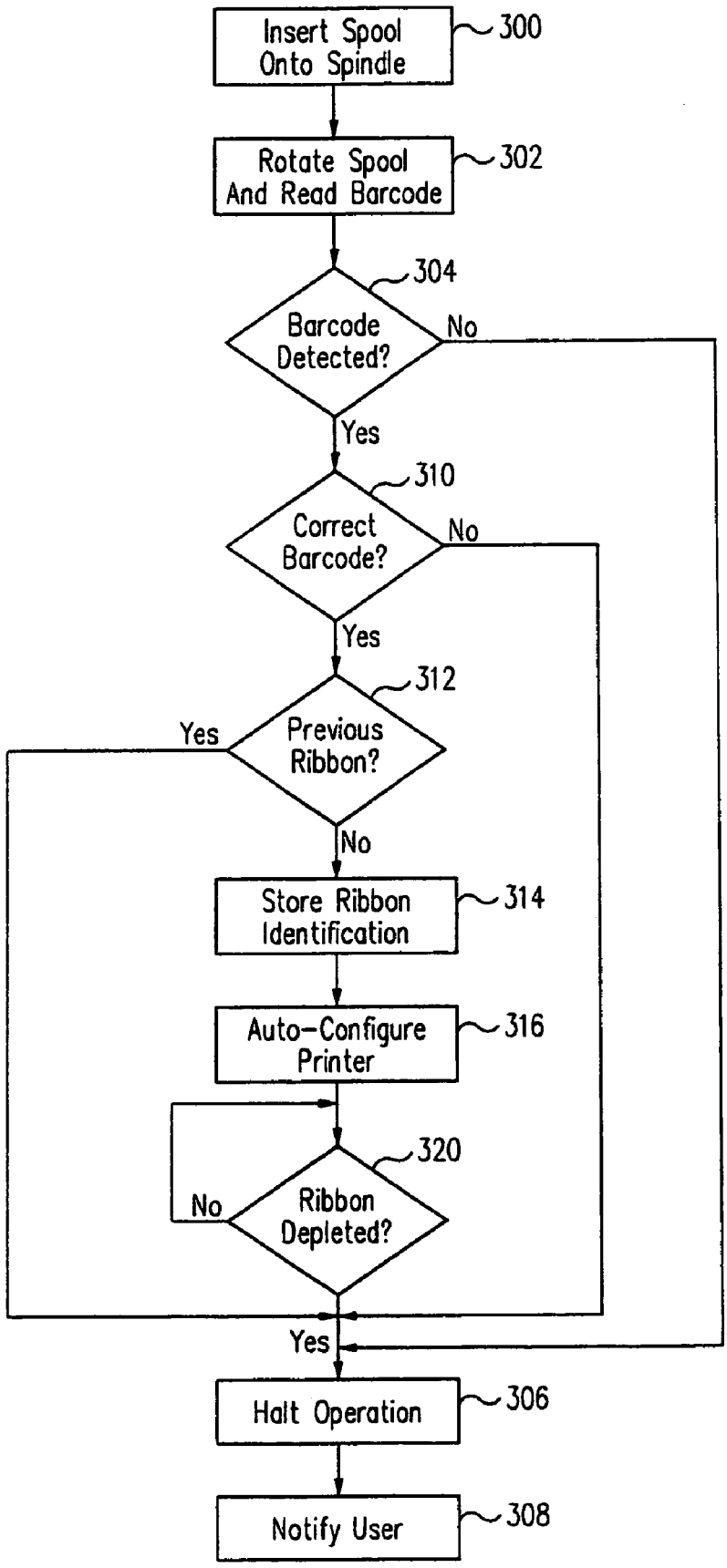
FIG. 3 is a flowchart illustrating a process using the ribbon identification in a printer system according to one embodiment of the invention.

FIG. 3 is a flow chart showing an operation using the radial barcode according to one embodiment. In operation 300, the spool containing the ribbon is inserted into the printer system, such as through a spindle. The spool is placed so that its attached radial barcode can be read by the printer system. The printer system is then controlled to rotate the spool, such as with a corresponding take-up spool in operation 302. During at least one complete revolution, the radial barcode is read by the printer system, such by an optical photo-detector. In operation 304, the printer system then determines, such as through a processor coupled to the photo-detector, whether a barcode is actually present on the spool. A non-existent barcode may indicate that an incompatible ribbon spool has been installed. If such a situation is detected, the printer system halts printer operation in operation 306. Optionally, the printer system then notifies the user in operation 308, such as with a visual indication that an unsuitable ribbon has been installed.

However, if in operation 304, the printer system determines that a barcode is present, the printer system then further determines in operation 310 whether the detected barcode is the correct barcode for the printer system. An incorrect barcode may indicate that the ribbon type is not for use with the printer, in which case, the printer halts operation in operation 306 and optionally notifies the user in operation 308. Since the printer system is configured to only accept ribbons of a certain type and to expect a certain type of identifier, if no identifier or an improper identifier is detected, the printer system assumes there is no ribbon or no acceptable ribbon. The printer system then acts accordingly, such as notifying the user of the situation.

If a correctly formatted barcode is detected in operations 304 and 310, the printer system reads the barcode to determine, in operation 312, if it was a previously used spool. The determination in operation 312 is made, in one embodiment, by comparing the ribbon spool identifier stored in the barcode with specific identifiers stored in the ribbon system, such in a memory within the processor. These specific identifiers represent ribbon spools that have previously been installed and used in the machine. Thus, if the current spool matches a previously used spool, this may mean that the ribbon is depleted, resulting in the printer halting its operation and optionally notifying the user.

However, if the printer system determines the ribbon is compatible and not previously used, the printer system stores identification information for that particular ribbon into memory in operation 314. Consequently, if this specific spool is re-installed at a later date, the printer system will recognize that the ribbon has been depleted and is unusable.

Next, in operation 316, the printer system automatically configures printing parameters in response to the ribbon characteristics of the installed spool. Printing at optimized settings then commences, in operation 318, without the need for the user to manually input settings.

During printing, the printer system monitors the amount of printing performed. As part of the information stored in the radial barcode, the printer system knows the length of the ribbon, which enables the printer to know how much printing can be performed before the ribbon is depleted. Once the printer system determines that the ribbon is depleted, in operation 320, printing is halted and the user is optically notified. If the ribbon is not depleted, printing continues until the ribbon is depleted, the print job is finished, the user manually halts the printing, or other conventional occurrence.

The various conditions resulting in the printer system halting printer operation prevents the printer system from being damaged or producing poor quality printing. Once the printing is stopped, the printer system automatically resets itself when the problem is resolved, such as replacing the spool with a new compatible spool.

Having thus described embodiments of the present invention, persons skilled in the art will recognize that changes may be made in form and detail without departing from the scope of the invention. Thus the invention is limited only by the following claims.

What is claimed is:

1. An identifier for a ribbon, comprising:

a plurality of sequential first bars of varying widths along at least an arc, wherein the arc is on a planar surface of a ribbon spool; and a plurality of sequential second bars of varying widths interspersed between the first bars, wherein the sequence of first and second bars represents a unique identification for the ribbon, a suitable ribbon for the printer, and each individual spool and wherein the sequence of first and second bars does not include start and stop characters and the sequence of first and second bars consisting the complete identifier spans an arc less than 360 degrees.

2. The identifier of claim 1, wherein the arc is less than 180 degrees.

3. The identifier of claim 1, wherein the first bars have a different reflectance than the second bars.

4. The identifier of claim 1, wherein the sequence of first and second bars represents a plurality of characteristics of the ribbon.

5. The identifier of claim 4, wherein the characteristics include the ribbon type and the ribbon length.

6. The identifier of claim 3, wherein the first bars are reflective to light and the second bars are non-reflective to light.

7. The identifier of claim 4, wherein the characteristics are represented by approximately fifty bits or less.

8. The ribbon spool of claim 7, wherein the barcode is printed on a label attached to the first circular plate.

9. The ribbon spool of claim 7, wherein the radial barcode further comprises identifiers for the ribbon type and the ribbon length.

10. The ribbon spool of claim 9, wherein the radial barcode comprises distinct fields for the ribbon type identifier, the ribbon length identifier, and the printer system identifier.

* * * * *